US008905004B2

(12) United States Patent
Kitamura et al.

(10) Patent No.: US 8,905,004 B2
(45) Date of Patent: Dec. 9, 2014

(54) CONTROL APPARATUS FOR INTERNAL COMBUSTION ENGINE

(75) Inventors: Natsuko Kitamura, Wako (JP); Akitsugu Ikeda, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 603 days.

(21) Appl. No.: 13/300,658

(22) Filed: Nov. 21, 2011

(65) Prior Publication Data

US 2012/0125296 A1 May 24, 2012

(30) Foreign Application Priority Data

Nov. 22, 2010 (JP) ..... 2010-260605

(51) Int. Cl.

| | |
|---|---|
| ***F02M 51/00*** | (2006.01) |
| ***F02D 41/20*** | (2006.01) |
| ***F02D 41/06*** | (2006.01) |
| ***F02D 41/26*** | (2006.01) |

(52) U.S. Cl.

CPC ..... *F02D 41/20* (2013.01); *F02D 41/062* (2013.01); *F02D 41/266* (2013.01); *F02D 2041/201* (2013.01); *F02D 2200/101* (2013.01)

USPC ..... 123/479; 123/478; 123/491; 701/113

(58) Field of Classification Search

CPC ..... F02D 1/06; F02D 41/062; F02D 41/20; F02D 41/2096; F02D 41/26; F02D 41/266; F02D 2400/14; F02D 2400/16; F02N 11/0862; F02N 11/0866

USPC ..... 123/478, 479, 480, 490, 491, 179.1, 123/179.3, 179.16, 179.17; 701/103, 113; 361/160

See application file for complete search history.

(56) References Cited

U.S. PATENT DOCUMENTS

| | | | | |
|---|---|---|---|---|
| 8,489,311 | B2 * | 7/2013 | Ranier et al. | 701/113 |
| 2006/0080027 | A1 * | 4/2006 | Tanaka et al. | 701/113 |
| 2006/0086333 | A1 * | 4/2006 | Toyoshima | 123/179.3 |
| 2006/0097577 | A1 * | 5/2006 | Kato et al. | 307/10.1 |
| 2010/0246086 | A1 * | 9/2010 | Ishiguro et al. | 361/160 |

FOREIGN PATENT DOCUMENTS

| | | |
|---|---|---|
| JP | S58-15737 | 1/1983 |
| JP | 2003-193946 | 7/2003 |
| JP | 2006-112243 | 4/2006 |
| JP | 2010-022077 | 1/2010 |
| JP | 2010-229877 | 10/2010 |

OTHER PUBLICATIONS

Japanese Office Action for corresponding JP Application No. 2010-260605, Nov. 9, 2012.

* cited by examiner

*Primary Examiner* — Erick Solis
*Assistant Examiner* — Anthony L Bacon
(74) *Attorney, Agent, or Firm* — Mori & Ward, LLP

(57) ABSTRACT

A control apparatus for an internal combustion engine includes a booster, a first controller, and a second controller. The booster is configured to increase an output voltage of a battery to a drive voltage of a fuel injection unit of the internal combustion engine. The first controller has a first initialization time after boot of the first controller. The first controller is configured to control the booster to increase the output voltage to the drive voltage at start-up of the internal combustion engine. The second controller has a second initialization time after boot of the second controller. The second initialization time is longer than the first initialization time of the first controller. The second controller is configured to control the booster to increase the output voltage to the drive voltage after the start-up of the internal combustion engine is completed.

7 Claims, 4 Drawing Sheets

CONTROL APPARATUS FOR INTERNAL COMBUSTION ENGINE

CROSS-REFERENCE TO RELATED APPLICATIONS

The present application claims priority under 35 U.S.C. §119 to Japanese Patent Application No. 2010-260605, filed Nov. 22, 2010, entitled "Control apparatus for internal combustion engine". The contents of this application are incorporated herein by reference in their entirety.

BACKGROUND OF THE INVENTION

1. Field of the Invention

The present invention relates to a control apparatus for an internal combustion engine.

2. Discussion of the Background

Since fuel injection apparatuses that directly inject fuel into cylinders in internal combustion engines have relatively high drive voltages, the fuel injection apparatuses have heretofore increased their battery voltages to achieve the drive voltages. In this case, if it takes time to perform initialization after boot in electronic control units (hereinafter referred to as "ECUs") controlling the drive voltages of the fuel injection apparatuses, there is a problem in that it takes time to achieve the drive voltages and, thus, the driving of the fuel injection apparatuses are delayed. This problem tends to be remarkable with the increasingly delayed initialization as the performance of the ECUs is improved and will be improved and the number of functions of the ECUs is increased and will be increased.

Japanese Unexamined Patent Application Publication No. 58-15737 discloses a large scale integration (LSI) device for controlling an automobile engine. This LSI device operates a circuit having an operating voltage that is lower than its battery voltage at start-up of the engine and operates a circuit having an operating voltage that is not lower than its battery voltage during normal operation.

SUMMARY OF THE INVENTION

According to one aspect of the present invention, a control apparatus for an internal combustion engine comprises a booster, a first controller, and a second controller. The booster is configured to increase an output voltage of a battery to a drive voltage of a fuel injection unit of the internal combustion engine. The first controller has a first initialization time after boot of the first controller. The first controller is configured to control the booster to increase the output voltage to the drive voltage at start-up of the internal combustion engine. The second controller has a second initialization time after boot of the second controller. The second initialization time is longer than the first initialization time of the first controller. The second controller is configured to control the booster to increase the output voltage to the drive voltage after the start-up of the internal combustion engine is completed.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
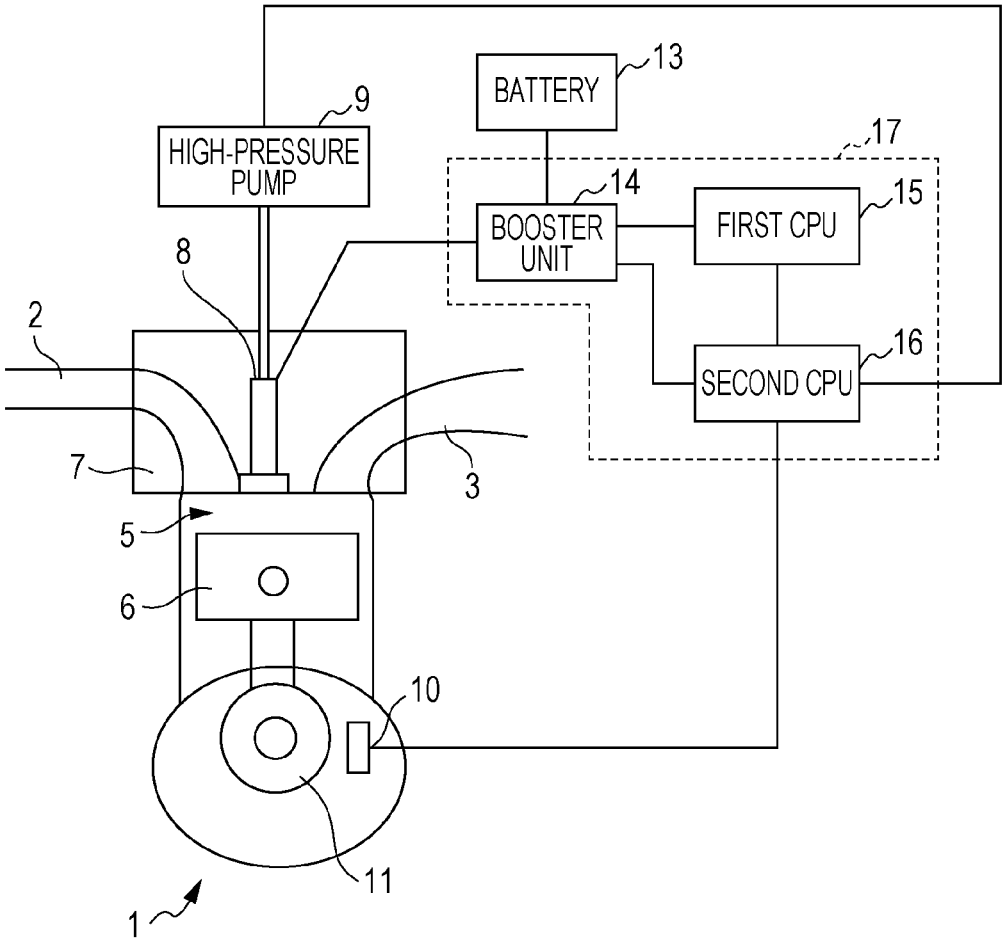
FIG. 1 illustrates an example of the entire configuration of a control apparatus for an internal combustion engine according to an embodiment of the present invention.

The embodiments will now be described with reference to the accompanying drawings, wherein like reference numerals designate corresponding or identical elements throughout the various drawings.

FIG. 1 illustrates an example of the entire configuration of a control apparatus for an internal combustion engine (hereinafter referred to as an engine) according to an embodiment of the present invention.

Referring to FIG. 1, an engine 1 is, for example, a four-cylinder four-cycle engine and only one cylinder is illustrated in FIG. 1. An intake pipe 2 and an exhaust pipe 3 are joined to the engine 1. A combustion chamber 5 is provided between a piston 6 and a cylinder 7. A fuel injection valve 8 is mounted so as to face on the combustion chamber 5.

The fuel injection valve 8 is connected to a high-pressure pump 9 and a fuel tank (not shown). The high-pressure pump 9 increases the pressure of fuel in the fuel tank to supply the fuel to the fuel injection valve 8. The fuel injection valve 8 injects the received fuel into the combustion chamber 5. The fuel injection valve 8 and the high-pressure pump 9 are controlled by a first central processing unit (CPU) 15 and a second CPU 16 described below.

A crank angle sensor 10 is provided in the engine 1. The crank angle sensor 10 supplies a CRK signal and a TDC signal to the second CPU 16 in response to the rotation of a crankshaft 11. The CRK signal is a pulse signal output for every predetermined crank angle. The second CPU 16 calculates a number of revolutions NE of the engine 1 on the basis of the CRK signal. The TDC signal is a pulse signal output at a crank angle related to a top dead center (TDC) position of the piston 6 at start of an intake stroke. In the case of the four-cylinder engine, the TDC signal is output for every 180 degree of the crank angle.

In the present embodiment, the stroke of each cylinder (that is, the phase of the crankshaft) is determined by the second CPU 16 receiving the CRK signal and the TDC signal. Storing the phase of the crankshaft with the engine stopped enables the fuel to be injected into an appropriate cylinder even before the determination of the cylinder by the second CPU 16. The CRK signal and the TDC signal may be supplied to the first CPU 15 and the stroke of each cylinder may be determined by the first CPU 15.

A booster unit 14 increases an output voltage from a battery 13 to a certain voltage and supplies the voltage to a driving mechanism (not shown) of the fuel injection valve 8 as a drive voltage for the fuel injection valve 8.

An electronic control unit (ECU) 17 is a computer including an input-output interface, a CPU, and a memory. The memory may store computer programs for realizing a variety of control and data necessary to execute the programs. The programs for the variety of control according to the embodiments of the present invention, the data used to execute the programs, and maps are stored in the memory. The ECU 17 receives data supplied from each control target and performs an operation to generate a control signal and supplies the control signal to each control target in order to control the control target.

The second CPU 16 has an initialization time after boot longer than that of the first CPU 15 and is generally a high-performance and highly functional computer. The initialization time means the time period during which the computer is booted, the execution of an initialization program is completed, and the processing involved in the execution of the programs for the variety of control becomes available.

The second CPU 16 controls the injection timing and the injection time of the fuel injection valve 8 and the pressure of the high-pressure pump 9. The first CPU 15 and the second CPU 16 control a boost operation by the booster unit 14. Specifically, the first CPU 15 causes the booster unit 14 to increase the voltage to the drive voltage at start-up of the engine 1 and the second CPU 16 causes the booster unit 14 to increase the voltage to the drive voltage after the start-up of the engine 1 is completed.

Figure 2:
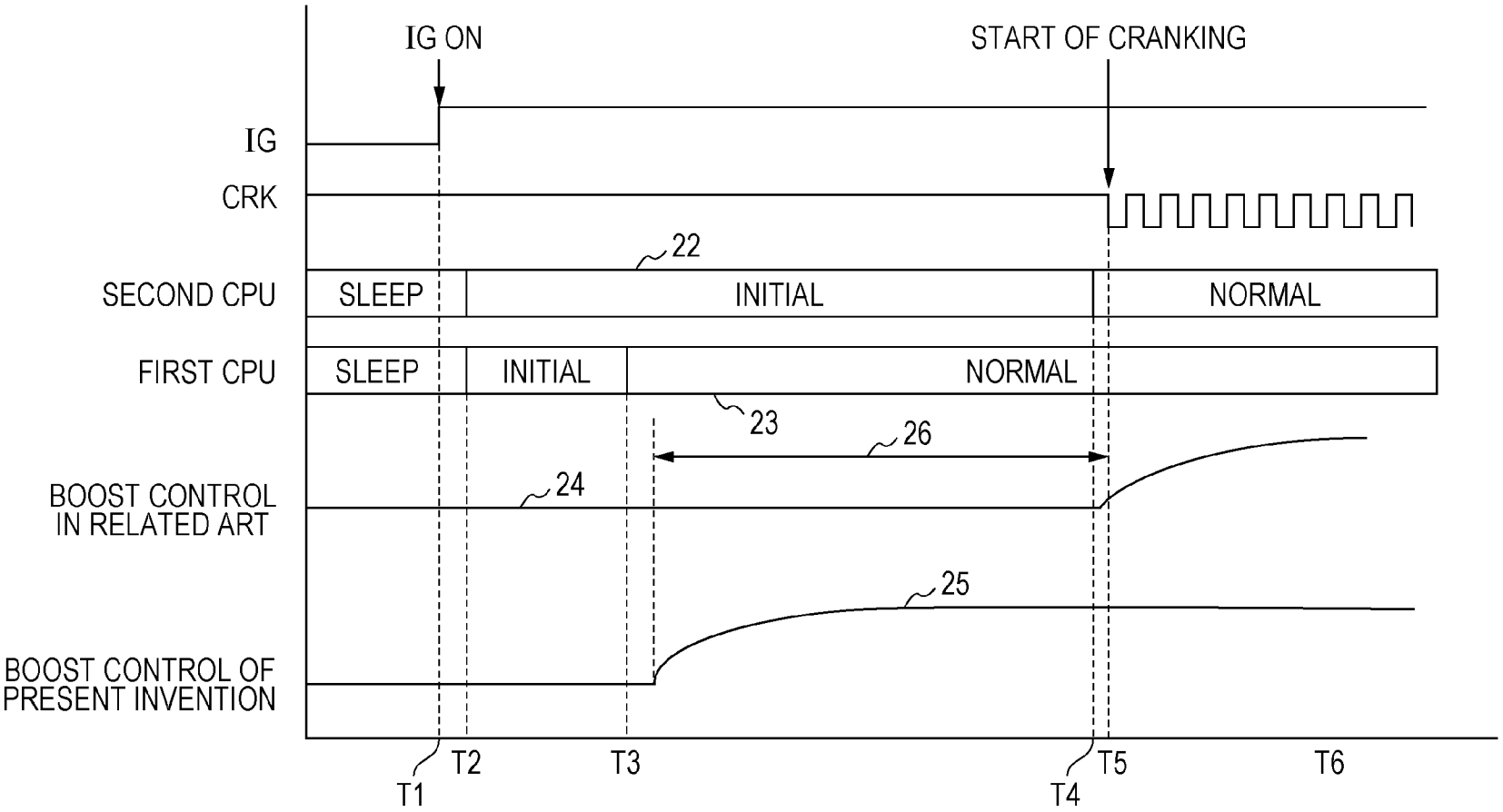
FIG. 2 is a timing chart indicating how a boost operation in a booster unit is controlled by a first CPU and a second CPU according to an embodiment of the present invention.

FIG. 2 is a timing chart indicating how the boost operation in the booster unit 14 is controlled by the first CPU 15 and the second CPU 16 according to an embodiment of the present invention. Boost control in related art (denoted by reference numeral 24) is also illustrated in FIG. 2 for comparison. Referring to FIG. 2, at a time T1, an ignition key is turned on (IG ON) and the engine 1 begins start-up. At a time T2 immediately after the time T1, the first CPU 15 and the second CPU 16 are almost simultaneously booted from a sleep state to start an initialization process (denoted by reference numerals 22 and 23). At a time T3, the first CPU 15 having a shorter initialization time (reference numeral 23) completes the initialization process to enter a normal operation state in which the variety of control is available. The first CPU 15 in the normal operation state causes the booster unit 14 to start the boost operation (denoted by reference numeral 25). At this time, the second CPU 16 having a longer initialization time (reference numeral 22) is during the initialization process. Accordingly, in the boost control in the related art, in which the boost control with the booster unit 14 is performed by one CPU, such as the second CPU 16, it is not possible to immediately start the boost control, as denoted by reference numeral 24 in FIG. 2.

At a time T4, the initialization process by the second CPU 16 is completed and the second CPU 16 enters the normal operation state. The boost operation in the boost control in the related art is started at this time (reference numeral 24). As apparent from comparison between reference numerals 24 and 25, in the boost control according to the present embodiment of the present invention (reference numeral 25), the boost operation in the booster unit 14 is started earlier than that in the boost control in the related art (reference numeral 24) by a time denoted by reference numeral 26.

At a time T5, cranking is started and the CRK pulse signal starts to be detected. At this time, the boost operation in the booster unit 14 under the control of the first CPU 15 is completed and the fuel injection valve 8 is ready for the injection of fuel. In contrast, since the boost operation has not been completed in the boost control in the related art (reference numeral 24), it is not possible to perform the fuel injection by the fuel injection valve 8. As described above, with the boost control according to the present embodiment of the present invention (reference numeral 25), it is possible to avoid a delay in the fuel injection, caused by a delay in the initialization of the ECU, to rapidly bring the engine 1 into the state in which the fuel injection is available.

At a time T6, the boost control by the first CPU 15 is switched to the boost control by the second CPU 16. The time T6 may be defined as, for example, the timing when the number of revolutions NE of the engine 1, calculated on the basis of the CRK signal, is larger than or equal to a certain value.

Figure 3:
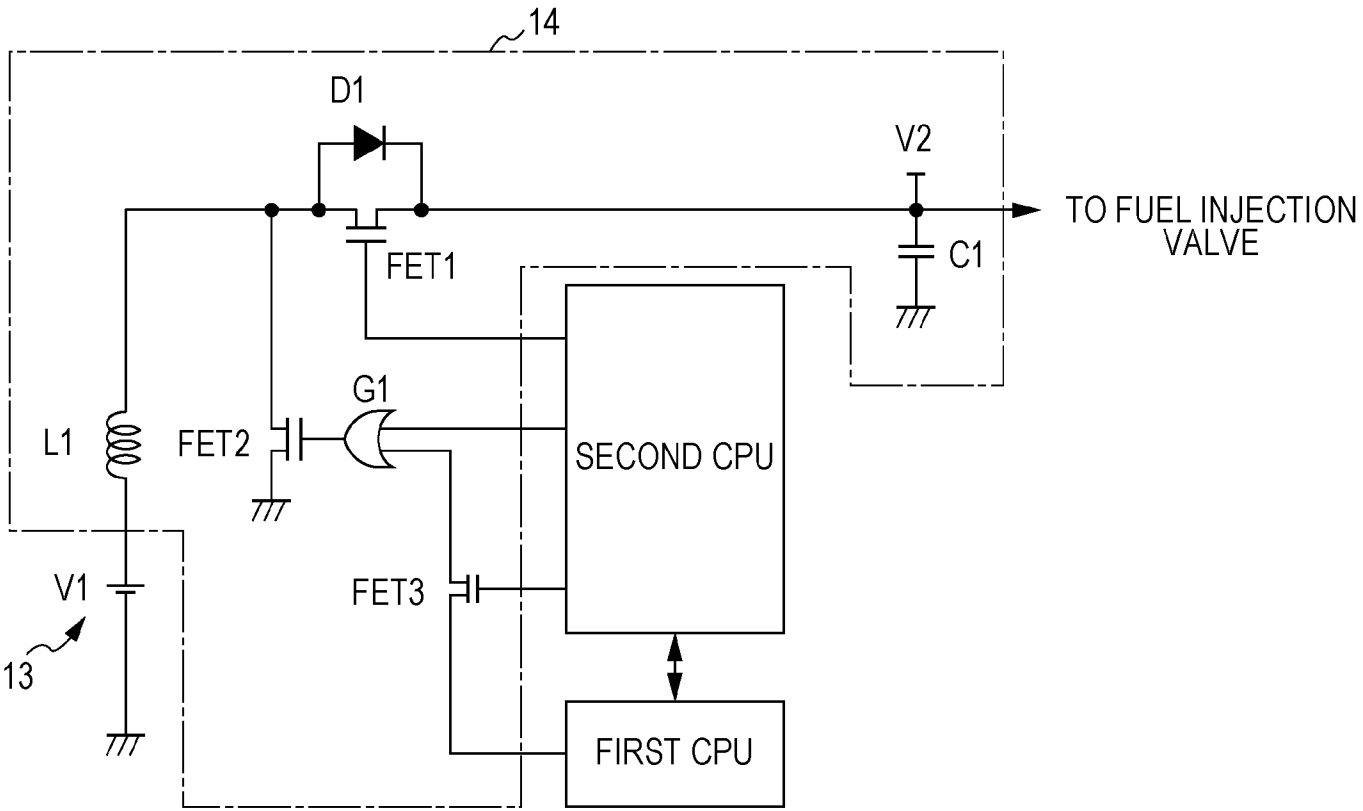
FIG. 3 illustrates an example of the configuration of the booster unit in the control apparatus according to an embodiment of the present invention.

The booster unit 14 in the control apparatus according to an embodiment of the present invention will now be described with reference to FIG. 3. The booster unit 14 may be provided as part of the ECU 17, as illustrated in FIG. 1, or may be provided as a separate unit. FIG. 3 illustrates an example of the configuration of the booster unit 14 in the control apparatus according to the embodiment of the present invention. The booster unit 14 in FIG. 3 corresponds to a so-called direct current-direct current (DC-DC) converter. The booster unit 14 increases an input voltage V1, such as the voltage from the battery 13, and supplies the voltage V1 to the driving mechanism of the fuel injection valve 8 as an output voltage V2. In the example in FIG. 3, the booster unit 14 has a feature of having both a diode rectification boost function and a synchronous rectification boost function and switching between these functions. Specifically, the diode rectification boost function is used in the boost control by the first CPU 15 described above and the synchronous rectification boost function is used in the boost control by the second CPU 16 described above. The switching between the diode rectification boost function and the synchronous rectification boost function is performed because, when only the diode rectification boost function is used, heat loss caused by the diode is increased. The synchronous rectification boost function having lower heat loss is also used to reduce the heat loss. The two booster functions may be realized by two circuitries controlled by the corresponding CPUs, instead of one circuitry, such as the one illustrated in FIG. 3.

A diode rectification boost circuit basically includes a coil L1, a diode D1, a capacitor C1, and a field effect transistor (FET)2 and is driven in response to the control signal input into the gate of the FET2. A synchronous rectification boost circuit basically includes the coil L1, an FET1, the capacitor C1, and the FET2 and is driven in response to the control signals input into the gates of the FET1 and the FET2. The above basic configuration (element configuration) is only an example and the present embodiment is applicable to cases in which similar functions can be achieved by using elements having the similar functions.

In the boost control by the first CPU 15, the first CPU 15 supplies an OFF signal to the gate of the FET1 and a gate G1 and simultaneously supplies an ON signal to the gate of an FET3. The first CPU 15 supplies the control signal to the FET2 through the FET3, which is turned on, and the gate G1 to perform on-off control to the FET2 on a certain cycle. Turning on-off of the FET2 causes the diode rectification boost circuit including the coil L1, the diode D1, the capacitor C1, and the FET2 to operate to increase the voltage V1.

In the boost control by the second CPU 16, the second CPU 16 supplies the OFF signal to the gate of the FET3 to block the control signal from the first CPU 15. The second CPU 16 supplies the control signal (ON or OFF signal) to the FET2 through the gate of the FET1 and the gate G1 to perform the on-off control to the FET1 and the FET2 on a certain cycle. Turning on-off of the FET1 and the FET2 causes the synchronous rectification boost circuit including the coil L1, the FET1, the capacitor C1, and the FET2 to operate to increase the voltage V1. The first CPU 15 is connected to the second CPU 16 via a signal line and is capable of exchanging the control signal with the second CPU 16.

Figure 4:
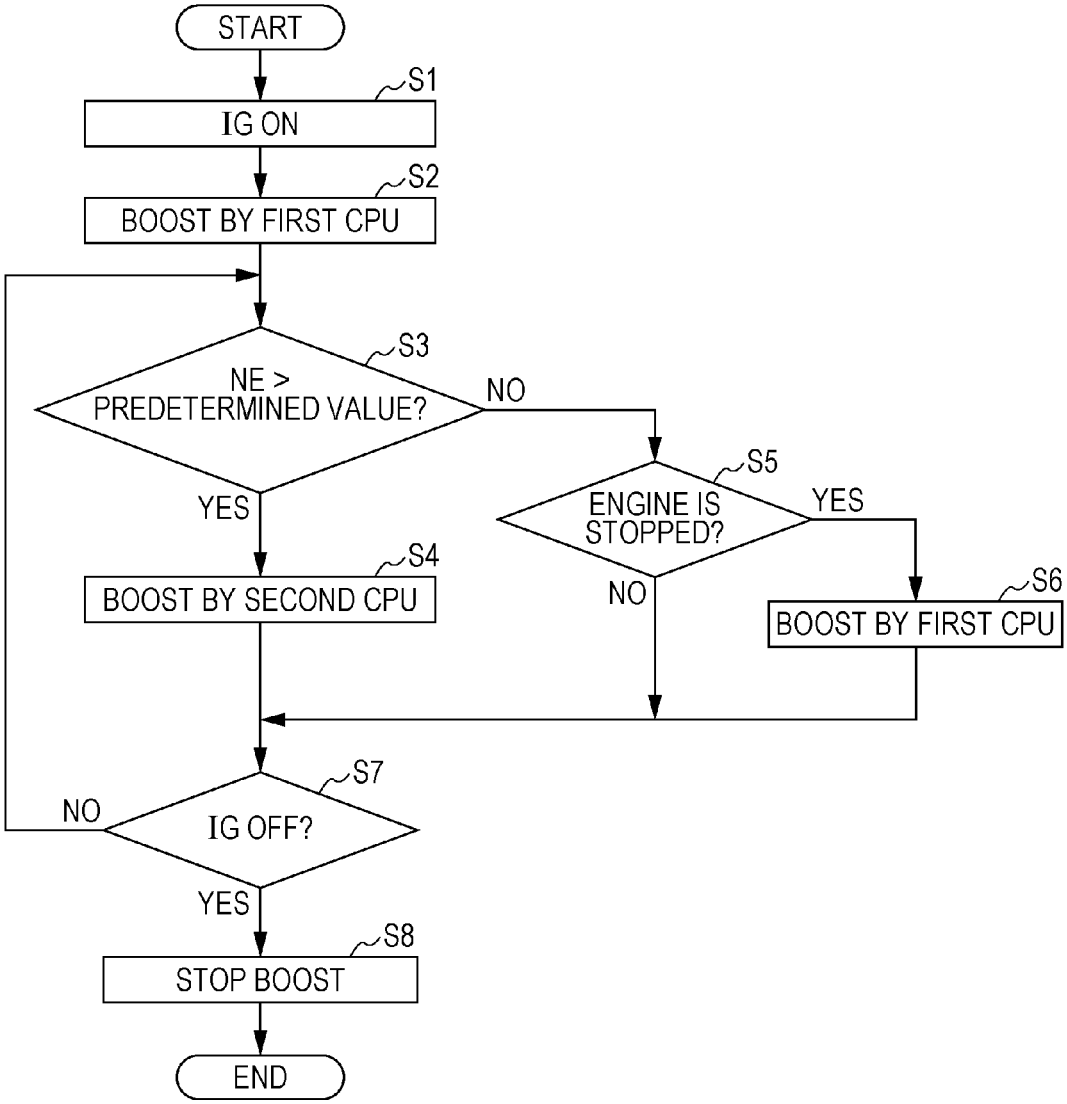
FIG. 4 is a flow chart illustrating an example of a boost control process performed by a control circuit according to an embodiment of the present invention.

A control process according to an embodiment of the present invention will now be described with reference to FIG. 4. FIG. 4 is a flow chart illustrating an example of a boost control process performed by a control circuit according to the embodiment of the present invention. The control process is performed by the first CPU 15 and the second CPU 16 on a certain cycle.

Referring to FIG. 4, in Step S1, the ignition key is turned on (IG ON) and the engine 1 begins start-up. In response to the start-up of the engine 1, the first CPU 15 and the second CPU 16 are booted from the sleep state to start the initialization process, as described above with reference to FIG. 2. In Step S2, the first CPU 15 having a shorter initialization time completes the initialization process and the control of the boost operation with the booster unit 14 is performed by the first CPU 15. The content of control is described above with reference to FIG. 3.

In Step S3, it is determined whether the number of revolutions NE of the engine 1 is larger than a predetermined value. The predetermined value used in this determination is set in advance as, for example, a predetermined value larger than the number of idle revolutions, at which the output voltage from the battery 13 is determined to be stable. Instead of the number of revolutions NE of the engine 1, another parameter may be used to detect, for example, the output voltage from the battery 13 and the detected value may be compared with a predetermined voltage value.

If the number of revolutions NE of the engine 1 is larger than the predetermined value (YES in Step S3), in Step S4, the control of the boost operation with the booster unit 14 is switched from the first CPU 15 to the second CPU 16 and the boost control is performed by the second CPU 16. This switching enables the highly accurate control by the second CPU 16 having a higher performance. In addition, for example, when the booster circuit illustrated in FIG. 3 is used, the boost control can be performed by the synchronous rectification boost circuit having lower heat loss to reduce the heat value.

If the number of revolutions NE of the engine 1 is not larger than the predetermined value (NO in Step S3), in Step S5, it is determined whether the engine 1 is stopped. If the engine is stopped because of an unanticipated reason other than the turning-off of the ignition key (IG OFF) (if the engine is stalled), the second CPU 16 may be reset and the output voltage from the battery 13 may become unstable at subsequent restart of the engine. The determination in Step S5 is performed in order to appropriately perform the subsequent boost control even in such a situation. If the engine is stopped (YES in Step S5), in Step S6, the boost control is performed by the first CPU 15, as in Step S2. When the boost control is being performed by the second CPU 16 at the determination, the boost control is switched from the second CPU 16 to the first CPU 15. Accordingly, for example, even if the engine is suddenly stopped, it is possible to rapidly restart the boost control and continue the boost control. If the engine is not stopped (NO in Step S5), the process goes to Step S7.

In Step S7, it is determined whether the ignition key is turned off (IG OFF). If the ignition key is not turned off (NO in Step S7), the process goes back to Step S3 to repeat the subsequent steps. If the ignition key is turned off (YES in Step S7), in Step S8, the boost control by the first CPU 15 and the second CPU 16 is stopped.

While the invention has been described in terms of exemplary embodiments, those skilled in the art will recognize that the invention can be practiced with modifications in the spirit and scope of the present invention.

According to an embodiment of the present invention, a control apparatus for an internal combustion engine including a fuel injection unit that directly injects fuel into a cylinder and a battery includes a first control unit; a second control unit having an initialization time after boot, which is longer than that of the first control unit; and a booster unit configured to increase an output voltage from the battery to a drive voltage for the fuel injection unit. The first control unit causes the booster unit to increase the voltage to the drive voltage at start-up of the internal combustion engine and the second control unit causes the booster unit to increase the voltage to the drive voltage after the start-up of the internal combustion engine is completed.

In the above control apparatus for the internal combustion engine, the control of the drive voltage for the fuel injection unit by the first control unit having a shorter initialization time is started at start-up of the internal combustion engine and the control of the drive voltage for the fuel injection unit is switched to the second control unit after the start-up of the internal combustion engine is completed. Accordingly, it is possible to avoid a delay in driving of the fuel injection unit to achieve both the reduction in the start-up time of the internal combustion engine and the highly accurate and highly efficient control.

The control apparatus may determine that the start-up of the internal combustion engine is completed if a number of revolutions of the internal combustion engine is larger than or equal to a predetermined value.

Even after the initialization of the second control unit is completed, the voltage from the battery may become unstable during the start-up and the second control unit may be reset if the internal combustion engine is operated at a low temperature or deterioration of the battery occurs. With the above control apparatus, monitoring the number of revolutions of the internal combustion engine allows the switching from the first control unit to the second control unit to be realized in a state in which the voltage from the battery is stable.

The predetermined value may be larger than a target number of revolutions during idle operation. If stop of the internal combustion engine, which is not based on a stop signal for the internal combustion engine, is detected during a time period after a start signal for the internal combustion engine has been given before the stop signal therefor is given and the number of revolutions of the internal combustion engine is smaller than the predetermined value, the first control unit may cause the booster unit to increase the voltage to the drive voltage.

With the above control apparatus, it is possible to reliably reduce the start-up time of the internal combustion engine even if the internal combustion engine is stopped because of a reason that is not anticipated by the operator or the control apparatus (if the engine is stalled) and, thus, the voltage from the battery becomes unstable during subsequent restart of the engine and the second control unit is reset.

The booster unit may include a diode rectification circuit and a synchronous rectification circuit, the first control unit may control the diode rectification circuit, and the second control unit may control the synchronous rectification circuit.

With the above control apparatus, it is possible to rapidly complete the start-up with the first control unit and to suppress heat loss in an increase in voltage with the second control unit during subsequent normal operation.

Obviously, numerous modifications and variations of the present invention are possible in light of the above teachings. It is therefore to be understood that within the scope of the appended claims, the invention may be practiced otherwise than as specifically described herein.

What is claimed is:

1. A control apparatus for an internal combustion engine, comprising:

a booster configured to increase an output voltage of a battery to a drive voltage of a fuel injection unit of the internal combustion engine;

a first controller having a first initialization time after boot of the first controller, the first controller being configured to control the booster to increase the output voltage to the drive voltage at start-up of the internal combustion engine; and a second controller having a second initialization time after boot of the second controller, the second initialization time being longer than the first initialization time of the first controller, the second controller being configured to control the booster to increase the output voltage to the drive voltage after the start-up of the internal combustion engine is completed.

2. The control apparatus according to claim 1, wherein the control apparatus determines that the start-up of the internal combustion engine is completed if a number of revolutions of the internal combustion engine is larger than or equal to a predetermined value.

3. The control apparatus according to claim 2, wherein the predetermined value is larger than a target number of revolutions during idle operation of the internal combustion engine, wherein if stop of the internal combustion engine is detected based on stop information other than a stop signal of the internal combustion engine during a first time period, and if the number of revolutions of the internal combustion engine is smaller than the predetermined value, the first controller controls the booster to increase the output voltage to the drive voltage, and wherein the first time period is a time period after a start signal of the internal combustion engine has been given and before the stop signal of the internal combustion engine is given.

4. The control apparatus according to claim 1, wherein the booster includes a diode rectification circuit and a synchronous rectification circuit, wherein the first controller is configured to control the diode rectification circuit, and wherein the second controller is configured to control the synchronous rectification circuit.

5. The control apparatus according to claim 3, wherein the start signal is based on turning-on of an ignition key, and wherein the stop signal is based on turning-off of the ignition key.

6. The control apparatus according to claim 3, wherein the stop information includes an engine stall.

7. The control apparatus according to claim 1, wherein the first controller starts controlling the booster to increase the output voltage to the drive voltage after a lapse of the first initialization time from turning-on of an ignition key.

* * * * *